US009170079B2

(12) United States Patent
Moore

(10) Patent No.: US 9,170,079 B2
(45) Date of Patent: Oct. 27, 2015

(54) LASER TRAINER CARTRIDGE

(76) Inventor: Larry E. Moore, Cottonwood, AZ (US)

( * ) Notice: Subject to any disclaimer, the term of this patent is extended or adjusted under 35 U.S.C. 154(b) by 0 days.

(21) Appl. No.: 13/353,165

(22) Filed: Jan. 18, 2012

(65) Prior Publication Data

US 2012/0224387 A1 Sep. 6, 2012

Related U.S. Application Data

(60) Provisional application No. 61/433,902, filed on Jan. 18, 2011.

(51) Int. Cl.

| | |
|---|---|
| ***F41G 1/32*** | (2006.01) |
| ***F41G 1/54*** | (2006.01) |
| ***F42B 12/42*** | (2006.01) |
| ***F42B 8/02*** | (2006.01) |

(52) U.S. Cl.

CPC . *F42B 12/42* (2013.01); *F41G 1/32* (2013.01); *F41G 1/54* (2013.01); *F42B 8/02* (2013.01)

(58) Field of Classification Search

USPC ..... 42/116, 114, 115, 134, 111

See application file for complete search history.

(56) References Cited

U.S. PATENT DOCUMENTS

| | | | | |
|---|---|---|---|---|
| 1,898,566 | A | | 2/1933 | Noel |
| 2,268,056 | A | | 12/1941 | Nelson et al. |
| 2,357,951 | A | | 9/1944 | Hale |
| 2,430,469 | A | | 11/1947 | Karnes |
| 2,597,565 | A | | 5/1952 | Chandler et al. |
| 2,773,309 | A | * | 12/1956 | Elliott ..... 42/134 |
| 2,780,882 | A | | 2/1957 | Temple |
| 2,826,848 | A | | 3/1958 | Davies |
| 2,844,710 | A | | 7/1958 | Rudolf |
| 2,904,888 | A | | 9/1959 | Niesp |
| 3,112,567 | A | | 12/1963 | Flanagan |
| 3,192,915 | A | | 7/1965 | Norris et al. |
| 3,284,905 | A | | 11/1966 | Simmons |
| 3,510,965 | A | | 5/1970 | Rhea |
| 3,526,972 | A | | 9/1970 | Sumpf |
| 3,573,868 | A | | 4/1971 | Giannetti |
| 3,641,676 | A | | 2/1972 | Knutsen et al. |
| 3,645,635 | A | | 2/1972 | Steck |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

USPTO; Advisory Action dated Jul. 13, 2012 in U.S. Appl. No. 12/249,781.

(Continued)

*Primary Examiner* — Jonathan C Weber
(74) *Attorney, Agent, or Firm* — Snell & Wilmer LLP

(57) ABSTRACT

A cartridge laser trainer fits into a gun barrel and includes a backer, circuit and a laser. When the firing pin of the gun is activated it strikes the backer, which contacts the circuit and activates the laser. The cartridge laser trainer may also have one or more O-rings to keep it positioned properly in the gun barrel. Also disclosed are kits that contain (1) a plurality of sheaths and a cartridge laser trainer, or (2) a plurality of O-rings and a cartridge laser trainer. Each sheath or O-ring(s) is configured to be positioned in a particular-sized gun bore and is configured to receive a cartridge laser trainer. With a kit, a single cartridge laser trainer can be used with more than one size of gun bore.

9 Claims, 7 Drawing Sheets

(56) References Cited

U.S. PATENT DOCUMENTS 3,801,205 A 4/1974 Eggenschwyler
3,914,873 A 10/1975 Elliot, Jr. et al.
3,992,783 A 11/1976 Dunlap et al.
3,995,376 A 12/1976 Kimble et al.
4,026,054 A 5/1977 Snyder
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,481,561 A 11/1984 Lanning
4,488,369 A 12/1984 Van Note
4,541,191 A 9/1985 Morris et al.
4,567,810 A 2/1986 Preston
4,713,889 A 12/1987 Santiago
4,763,431 A 8/1988 Allan et al.
4,825,258 A 4/1989 Whitson
4,830,617 A * 5/1989 Hancox et al. ..... 434/21
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A * 9/1991 Hepp ..... 42/70.11
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,228,427 A 7/1993 Gardner, Jr.
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langer
5,455,397 A 10/1995 Havenhill et al.
5,467,552 A 11/1995 Cupp et al.
5,481,819 A 1/1996 Teetzel
5,488,795 A * 2/1996 Sweat ..... 42/116
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A * 11/1997 Shoham ..... 42/116
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A * 6/1999 Johnsen et al. ..... 362/111
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A * 11/2000 Cox et al. ..... 33/286
6,219,952 B1 4/2001 Mossberg et al.
6,230,431 B1 5/2001 Bear
6,237,271 B1 5/2001 Kaminski
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,345,464 B1 2/2002 Kim et al.
6,363,648 B1 4/2002 Kranich
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 * 5/2002 Millard ..... 42/116
6,397,509 B1 * 6/2002 Langner ..... 42/116
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 * 6/2003 Shechter ..... 434/21
6,591,536 B2 7/2003 Houde-Walter et al.
6,606,797 B1 * 8/2003 Gandy ..... 33/227
6,616,452 B2 9/2003 Clark et al.
6,622,414 B1 9/2003 Oliver et al.
6,631,580 B2 * 10/2003 Iafrate et al. ..... 42/134
6,631,668 B1 10/2003 Wilson et al.
6,650,669 B1 11/2003 Adkins
6,671,991 B1 1/2004 Danielson
D487,791 S 3/2004 Freed
6,742,299 B2 * 6/2004 Strand ..... 42/134

(56) References Cited

U.S. PATENT DOCUMENTS 6,782,789 B2 8/2004 McNulty
6,854,205 B2 2/2005 Wikle et al.
6,931,775 B2 8/2005 Burnett
6,935,864 B2 8/2005 Shechter et al.
6,966,775 B1 11/2005 Kendir et al.
7,032,342 B2 4/2006 Pikielny
7,049,575 B2 5/2006 Hotelling
7,111,424 B1 9/2006 Moody et al.
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
RE40,429 E * 7/2008 Oliver et al. ..... 42/116
D578,599 S 10/2008 Cheng
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,104,220 B2 1/2012 Cobb
D653,798 S 2/2012 Janice et al.
8,109,024 B2 2/2012 Abst
8,110,760 B2 2/2012 Sharrah et al.
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,151,504 B1 4/2012 Aiston
8,151,505 B2 4/2012 Thompson
8,166,694 B2 5/2012 Swan
8,172,139 B1 5/2012 McDonald et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
D697,162 S 1/2014 Faifer
8,661,725 B1 3/2014 Ganther et al.
8,734,156 B2 5/2014 Uhr
8,739,447 B2 6/2014 Merritt et al.
8,844,189 B2 9/2014 Moore et al.
8,919,023 B2 12/2014 Merritt et al.
8,938,904 B1 1/2015 Sellers et al.
8,944,838 B2 2/2015 Mulfinger
2001/0042335 A1* 11/2001 Strand ..... 42/116
2002/0009694 A1 1/2002 Rosa
2002/0051953 A1 5/2002 Clark et al.

(56) References Cited

U.S. PATENT DOCUMENTS

| | | | | |
|---|---|---|---|---|
| 2002/0057719 | A1* | 5/2002 | Shechter | 372/16 |
| 2002/0073561 | A1 | 6/2002 | Liao | |
| 2002/0129536 | A1* | 9/2002 | Iafrate et al. | 42/134 |
| 2002/0134000 | A1 | 9/2002 | Varshneya et al. | |
| 2002/0194767 | A1 | 12/2002 | Houde Walter et al. | |
| 2003/0003424 | A1 | 1/2003 | Shechter et al. | |
| 2003/0029072 | A1 | 2/2003 | Danielson | |
| 2003/0175661 | A1 | 9/2003 | Shechter et al. | |
| 2003/0180692 | A1 | 9/2003 | Skala et al. | |
| 2003/0196366 | A1 | 10/2003 | Beretta | |
| 2004/0003529 | A1 | 1/2004 | Danielson | |
| 2004/0010956 | A1 | 1/2004 | Bubits | |
| 2004/0014010 | A1 | 1/2004 | Swensen et al. | |
| 2005/0044736 | A1 | 3/2005 | Liao | |
| 2005/0153262 | A1 | 7/2005 | Kendir | |
| 2005/0185403 | A1 | 8/2005 | Diehl | |
| 2005/0188588 | A1 | 9/2005 | Keng | |
| 2005/0241209 | A1 | 11/2005 | Staley | |
| 2005/0257415 | A1 | 11/2005 | Solinsky et al. | |
| 2005/0268519 | A1 | 12/2005 | Pikielny | |
| 2006/0162225 | A1 | 7/2006 | Danielson | |
| 2006/0191183 | A1 | 8/2006 | Griffin | |
| 2007/0039226 | A1 | 2/2007 | Stokes | |
| 2007/0041418 | A1 | 2/2007 | Laughman et al. | |
| 2007/0056203 | A1 | 3/2007 | Gering et al. | |
| 2007/0113460 | A1 | 5/2007 | Potterfield et al. | |
| 2007/0190495 | A1 | 8/2007 | Kendir et al. | |
| 2007/0258236 | A1 | 11/2007 | Miller | |
| 2007/0271832 | A1 | 11/2007 | Griffin | |
| 2008/0000133 | A1 | 1/2008 | Solinsky et al. | |
| 2008/0060248 | A1 | 3/2008 | Pine et al. | |
| 2008/0134562 | A1 | 6/2008 | Teetzel | |
| 2009/0013580 | A1 | 1/2009 | Houde-Walter | |
| 2009/0013581 | A1 | 1/2009 | LoRocco | |
| 2009/0178325 | A1 | 7/2009 | Veilleux | |
| 2009/0183416 | A1 | 7/2009 | Danielson | |
| 2009/0293335 | A1 | 12/2009 | Danielson | |
| 2009/0293855 | A1 | 12/2009 | Danielson | |
| 2010/0058640 | A1 | 3/2010 | Moore | |
| 2010/0162610 | A1 | 7/2010 | Moore et al. | |
| 2010/0175297 | A1 | 7/2010 | Speroni | |
| 2010/0229448 | A1 | 9/2010 | Houde-Walter | |
| 2010/0275496 | A1 | 11/2010 | Solinsky et al. | |
| 2011/0047850 | A1 | 3/2011 | Rievley et al. | |
| 2011/0061283 | A1 | 3/2011 | Cavallo | |
| 2011/0162249 | A1 | 7/2011 | Woodmansee et al. | |
| 2011/0185619 | A1 | 8/2011 | Finnegan et al. | |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2013/0185982 | A1 | 7/2013 | Hilbourne et al. | |
| 2013/0263492 | A1 | 10/2013 | Erdle | |
| 2014/0109457 | A1 | 4/2014 | Speroni | |

OTHER PUBLICATIONS

USPTO; Final Office Action dated Aug. 7, 2012 in U.S. Appl. No. 12/249,781.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Dec. 26, 2008 in U.S. Appl. No. 11/317,647.
USPTO; Office Action dated Jun. 19, 2009 in U.S. Appl. No. 11/317,647.
USPTO; Office Action dated Sep. 28, 2009 in U.S. Appl. No. 11/317,647.
USPTO; Office Action dated Feb. 24, 2010 in U.S. Appl. No. 11/317,647.
USPTO; Office Action dated Nov. 8, 2010 in U.S. Appl. No. 12/249,781.
USPTO; Final Office Action dated May 18, 2011 in U.S. Appl. No. 12/249,781.
USPTO; Advisory Action dated Aug. 22, 2011 in U.S. Appl. No. 12/249,781.
USPTO; Office Action dated Jan. 26, 2012 in U.S. Appl. No. 12/249,781.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Office Action dated Oct. 6, 2010 in U.S. Appl. No. 12/249,794.
USPTO; Notice of Allowance dated Feb. 2, 2011 in U.S. Appl. No. 12/249,794.
USPTO; Notice of Allowance dated Jul. 8, 2011 in U.S. Appl. No. 12/249,794.
USPTO; Office Action dated Oct. 18, 2011 in U.S. Appl. No. 12/610,213.
EPO; Search Opinion and Report dated Aug. 23, 2010 in Serial No. 09169476.
EPO; Search Opinion and Report dated Aug. 6, 2010 in Serial No. 0969469.
EPO; Office Action dated Oct. 5, 2011 in Serial No. 09169469.
EPO; Search Opinion and Re dated Aug. 6, 2010 in Serial No. 09169459.
EPO; Office Action dated Oct. 5, 2011 in Serial No. 09169459.
USPTO; Notice of Allowance dated May 17, 2011 in U.S. Appl. No. 13/077,861.
USPTO; Notice of Allowance dated Sep. 1, 2011 in U.S. Appl. No. 13/077,861.
USPTO; Notice of Allowance dated Nov. 18, 2011 in U.S. Appl. No. 13/077,861.
USPTO; Office Action dated Jun. 22, 2011 in U.S. Appl. No. 13/077,875.
USPTO; Notice of Allowance dated Nov. 1, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Report and Opinion dated Aug. 6, 2012 in Serial No. 11151504.
USPTO; Office Action dated Feb. 20, 2013 in U.S. Appl. No. 13/670,278.
USPTO; Office Action dated Mar. 26, 2013 in U.S. Appl. No. 13/353,241.
EPO; Office Action dated Dec. 20, 2011 in Application No. 09169476.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Notice of Allowance dated Feb. 26, 2002 in U.S. Appl. No. 09/624,124.
USPTO; Office Action dated Jun. 11, 2001 in U.S. Appl. No. 09/624,124.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.

(56) References Cited

OTHER PUBLICATIONS

Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated, "Update on the .25 SAUM" Jul. 2005 pp. 14-15.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Office Action dated Jun. 24, 2013 in U.S. Appl. No. 13/670,278.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Notice of Allowance dated Jan. 18, 2012 in U.S. Appl. No. 13/353,301.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Office Action dated Mar. 3, 2015 in U.S. Appl. No. 14/278,315.

* cited by examiner

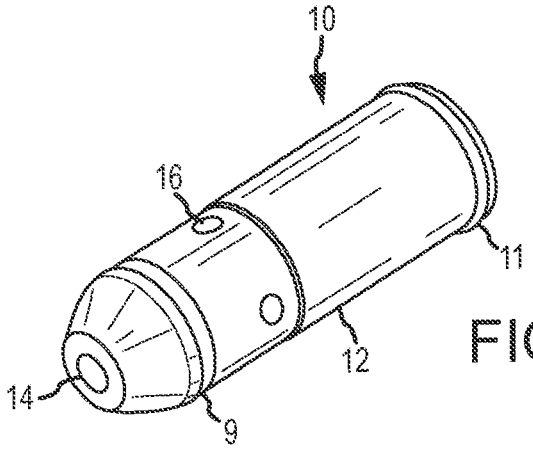
FIG.4
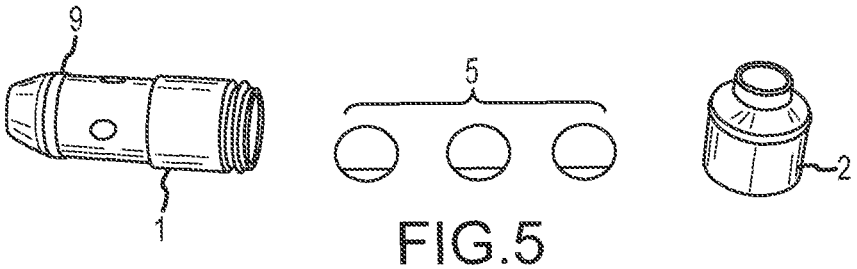
FIG.5
FIG.6
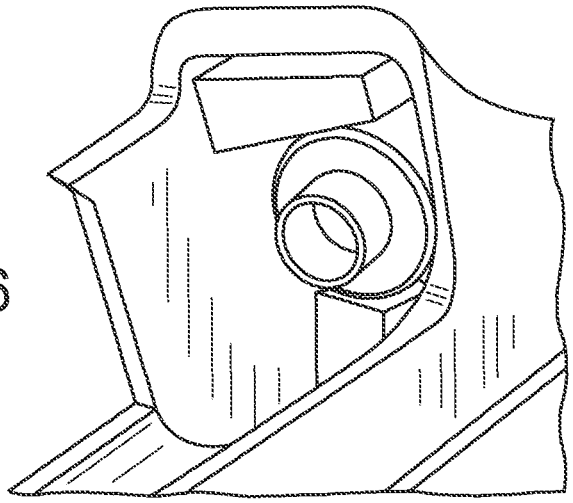

LASER TRAINER CARTRIDGE

CROSS REFERENCE TO RELATED APPLICATIONS

This application claims priority to and incorporates by reference the disclosure of U.S. Provisional Patent Application No. 61/433,902 entitled LASER TRAINER CARTRIDGE AND LASER TRAINER TARGET, filed on Jan. 18, 2011. The disclosure of co-pending U.S. application Ser. No. 13/353,241 entitled "Laser Trainer Target" to Larry E. Moore, filed on Jan. 18, 2012 is incorporated herein by reference.

FIELD OF THE INVENTION

The present invention relates to firearm training systems that do not require live ammunition.

BACKGROUND OF THE INVENTION

Conventional firearm training can be dangerous, expensive (considering the prices for ammunition and replacement targets) and can only be performed in certain areas, such as shooting ranges. The present invention allows firearm training to be performed safely, inexpensively, and almost anywhere without the use of live ammunition.

SUMMARY OF THE INVENTION

A laser trainer cartridge (or "laser cartridge" or "cartridge") according to various aspects of the invention is configured to fit inside the chamber (or bore) of a firearm and includes a firing-pin activated switch to emit a laser light to indicate where a bullet would strike. Among other things, the laser trainer cartridge provides realistic firearms training, preferably allowing a user to practice tap, rack, bang and malfunction drills. The laser training cartridge can be configured to operate with essentially any desired firearm of any caliber.

The cartridge is preferably cylindrical with a cylindrical outer surface. One or more O-rings comprised of compressible material are positioned on the outer surface, entirely or partially around the cartridge, in order to center the cartridge snugly in the barrel of a gun. A kit of the cartridges may be provided wherein there is a different sized cartridge/O-ring combination for different calibers of guns (and the cartridges may all be the same size, with different O-rings for different gun calibers). Alternatively, a kit may include a single cartridge and different-sized O-rings, wherein each different sized O-ring or set of O-rings is sized to fit a particular caliber of gun. In that case, one or more O-rings can be positioned on the cartridge to enable the cartridge/O-ring combination to fit a particular caliber gun, and the O-ring(s) could be changed so the cartridge/O-ring combination would fit a different caliber gun.

Also disclosed is a sheath that may be used to fit a cartridge snugly into a gun bore. The sheath is preferably a hollow tube that receives and retains the cartridge. This can be accomplished in any suitable manner, such as by (1) the sheath having internal structures, such as flexible members, that retain the cartridge, (2) the sheath being shaped to retain the cartridge, or (3) the cartridge having an external structure, such as one or more of the previously described O-rings, which in this case would cause the cartridge to fit snugly inside the sheath.

The sheath has one or more O-rings positioned on its exterior surface that enable it to be fit snugly into the bore of a gun. A kit could contain a single cartridge and multiple sheaths. Each of the multiple sheaths preferably would have essentially the same interior diameter and each could receive and retain the single cartridge, and at least some (or all) of the sheaths would have different-sized O-rings on their exterior surface. Therefore, different sheaths would fit snugly in guns having different bore sizes. In this manner, a single cartridge can be used with guns having different, respective bore sizes by changing the sheath.

BRIEF DESCRIPTION OF THE DRAWINGS

FIGS. 1-4 are perspective views of exemplary laser trainer cartridges of different sizes, wherein each is configured to fit in a different caliber firearm.

FIG. 5 depicts the laser trainer cartridge of FIG. 1 that is partially disassembled.

FIG. 6 is a perspective view showing the laser trainer cartridge of FIG. 1 positioned inside the barrel of a firearm.

DETAILED DESCRIPTION OF THE INVENTION

Figure 1:
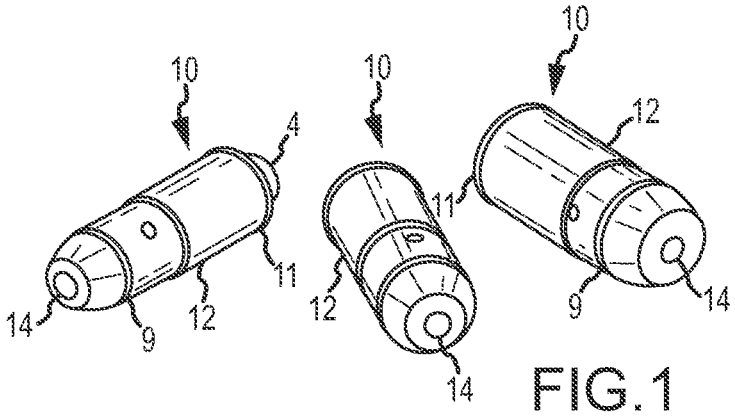
Figure 2:
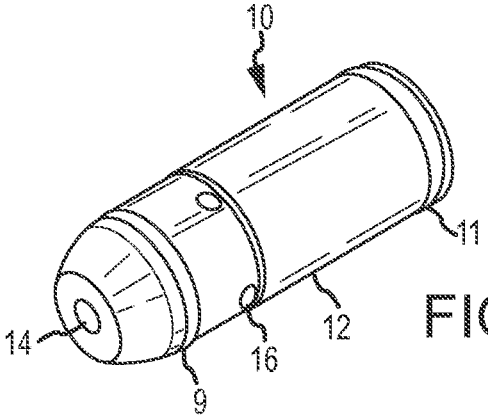
Figure 3:
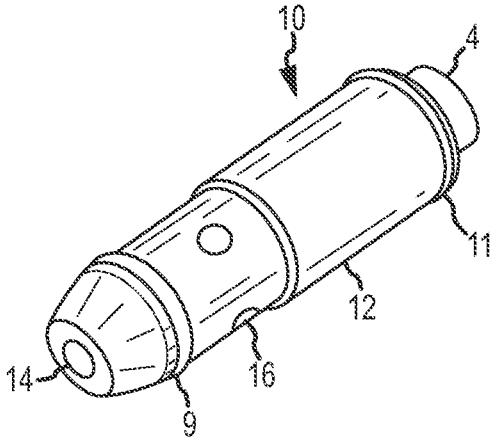

Turning now to the Figures, where the purpose is to describe preferred embodiments of the invention and not to limit same, the laser trainer cartridge 10 may be configured to operate in conjunction with firearms of essentially any desired caliber and regardless of the barrel length of the firearm. The only difference between the laser cartridges 10 shown in FIGS. 1-4 is their size. Each has the same structure as described herein.

A cartridge 10 according to a preferred embodiment has a size and shape similar to a bullet. Cartridge 10 has an exterior surface 12, an opening 14 through which light is emitted, a removable backer 4, apertures 16 that house adjustment screws 7 that can adjust the position of laser module 6 (best seen in FIG. 7) that preferably emits visible, red laser light. In this embodiment, two O-rings 9 and 11 are positioned in grooves, or next to ridges, on exterior surface 12, and have an outer diameter greater than the outer diameter of cartridge 10.

In certain embodiments, a laser trainer cartridge 10 of the invention is configured to fit a firearm having a caliber of 9 mm, .32 cal, .38 cal, .40 cal., .44 cal., .45 cal, or .50 cal. The laser trainer cartridge 10 may be configured to fit snugly into the firing chamber (or bore) of essentially any desired firearm. The cartridge 10 is preferably configured so that it fits into the chamber of a gun in the same manner as a bullet.

The cartridge 10 is configured to emit light, which is preferably laser light, for any desired duration. In one embodiment, a laser trainer cartridge 10 includes a laser module 6, which in the preferred embodiment is a visible, red light laser module. In this embodiment, the laser module 6 activates for 100 milliseconds each time the firing pin strikes the backer 4 of cartridge 10, although any suitable activation duration can be selected. The laser trainer cartridge 10 is preferably rimless, so that it is not expelled during dry fire, which can allow for tap, rack, bang or malfunction training drills.

In one embodiment, a hardened rubber plunger (or backer 4) on the cartridge 10 also acts as a built-in snap cap to protect the firing pin of the gun when it strikes the backer 4. Backer 4 is thus pressure fit, or snap fit, into the end of cartridge 10 opposite opening 14 as cartridge 10 is assembled.

The cartridge 10 includes at least one rubber ring, which is preferably an O-ring, that is pressure fit onto the outer surface 12 of the cartridge 10, and most preferably two rubber O-rings are pressure fit onto surface 12. As shown, two rubber O-rings 9, 11 on the laser trainer cartridge 10 help ensure a snug fit in the gun bore. Front O-ring 9 is positioned on the front portion of cartridge 10, and rear O-ring 11 is positioned on the back portion of the cartridge 10. Among other things, the O-rings help to prevent the cartridge 10 from falling out of the gun, reduce vibration from the firing pin striking the backer 4, and retain the cartridge 10 in position while in use. The front O-ring 9 and rear O-ring 11 each preferably have a diameter equal to, or greater than, the diameter of the bore of the gun. In some embodiments, the front O-ring 9 and rear O-ring 11 have a diameter of equal to, or up to 0.030" greater than, the diameter of the bore of the gun barrel in which cartridge 10 is used. The O-rings 9 and 11 may be any size, shape, and configuration, and may be formed from any suitable material to allow cartridge 10 to fit snugly in the bore of a firearm and help reduce vibration and movement when the backing 4 of cartridge 10 is struck by the firing pin.

In one embodiment, the laser trainer cartridge is powered by three 377-type batteries 5 (shown in FIGS. 7 and 9) that fit in an internal cavity 22 of the laser trainer cartridge 10 to provide power to a circuit 8 (such as the exemplary circuit in FIG. 9), which utilizes 4-4.5 V. In this embodiment, the batteries 5 provide enough power for approximately 3,000 emissions of laser light that simulate a bullet being fired.

Figure 7:
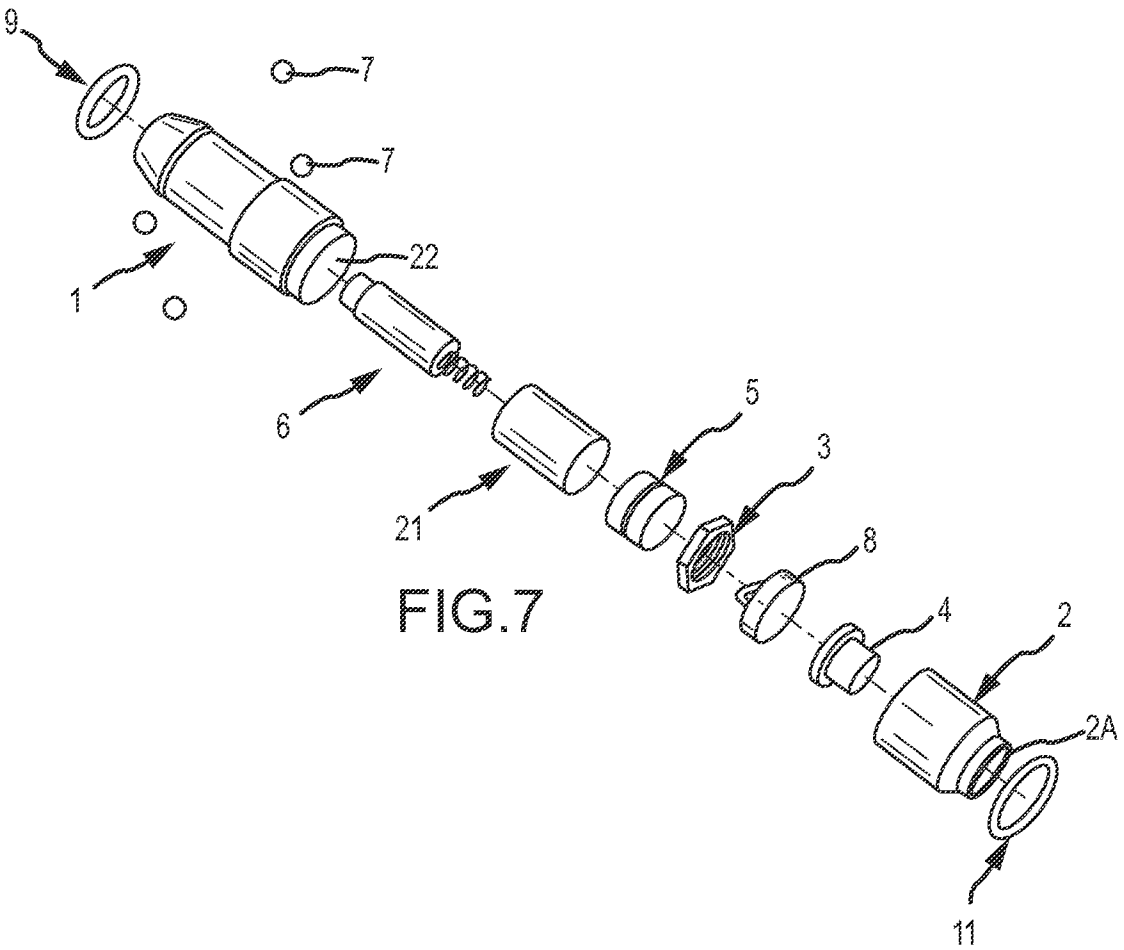
FIG. 7 is an exploded, perspective view of a laser trainer cartridge in accordance with FIGS. 1-4.
Figure 8:
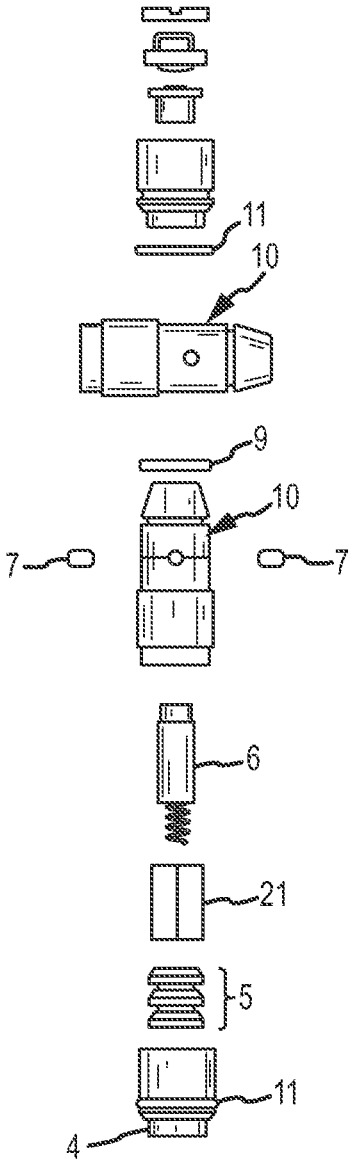
FIG. 8 illustrates the separate components of a laser trainer cartridge according to the invention.

FIG. 7 depicts an exploded view of an exemplary laser trainer cartridge 10 according to various aspects of the invention. In this embodiment, the laser trainer cartridge 10 includes an outer casing formed by components 1 and 2. A backer 4 in the exemplary embodiment of FIG. 7 is positioned at the rear of the cartridge 10 so it can be struck by the firing pin of the gun when the gun is fired (i.e., when a user pulls the trigger of the gun). The backer 4 has a first position where it is not in contact with a circuit 8 and a second position where the backer 4 contacts the circuit 8. When assembled, backer 4 can be struck by the firing pin of a gun through opening 2A of body portion 2. When the backer 4 is struck by the firing pin of the gun, the backer moves from the first position to the second position, and the circuit 8 causes the laser module 6 to illuminate.

The backer 4 may be of any suitable size, shape, and configuration, and may be formed from any suitable material. In one exemplary embodiment, the backer 4 is formed from urethane. In one embodiment, the material forming the backer is urethane having a durometer of about 85 Shore A. In alternate embodiments, the backer has a durometer of between about 75 and about 95 Shore A.

The batteries 5 are preferably insulated from the body of the cartridge 10 by a mylar sleeve 21. The laser module 6 may be of any suitable size, shape, and configuration, and may emit light of any desired shape, intensity, and color.

Figure 9:
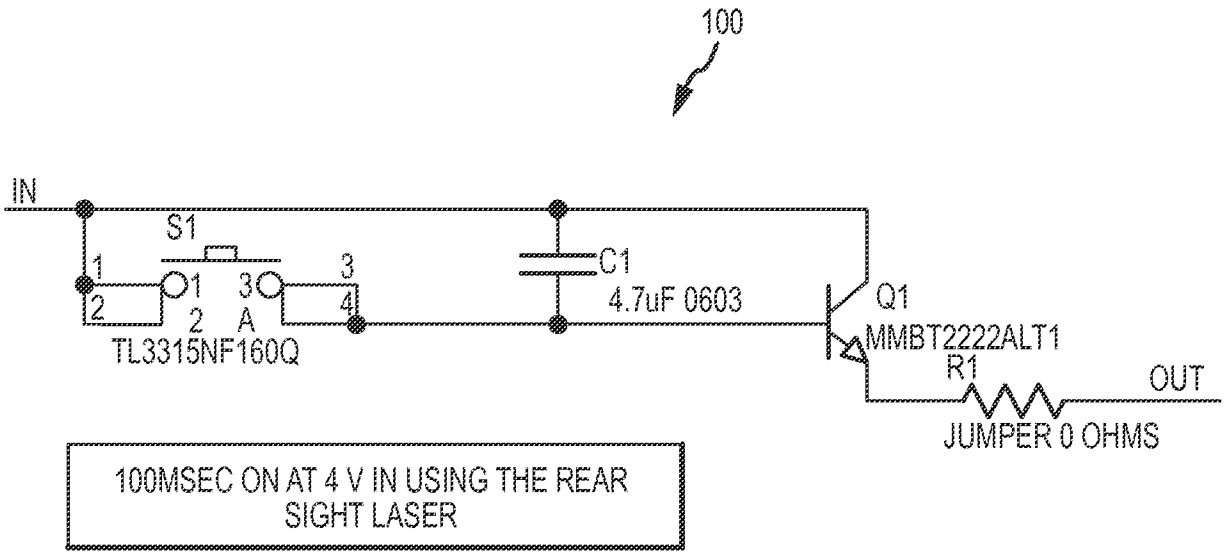
FIG. 9 depicts an exemplary circuit that may be utilized by the laser trainer cartridge of the invention.
Figure 10:
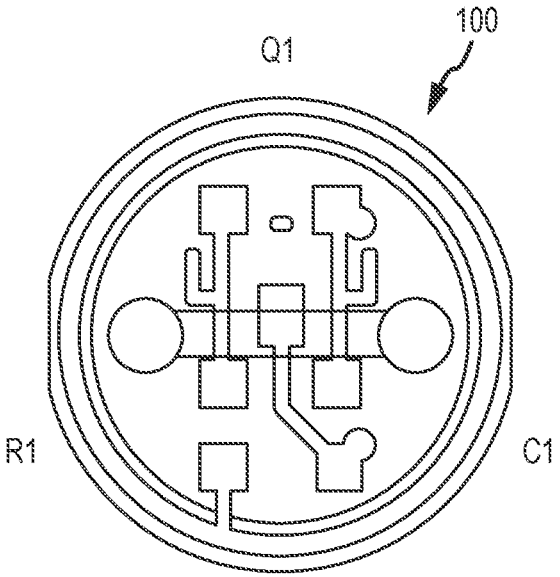
FIGS. 10 and 11 illustrate the top and bottom trace patterns, respectively, on a printed wiring board including the circuit of FIG. 12.
Figure 11:
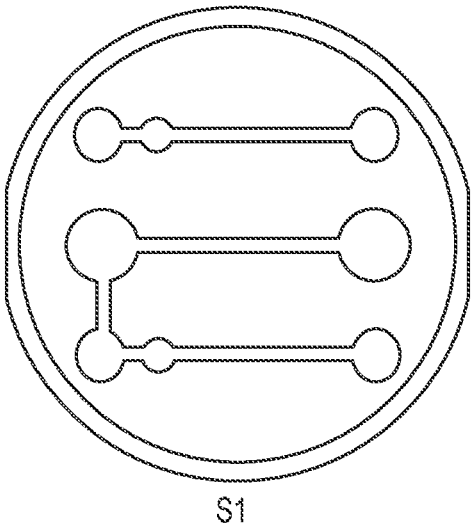

FIGS. 10-11 depict an exemplary circuitry 100 that may be implemented in circuit 8 of FIG. 10. In this circuitry 100, the backer moving to its second position actuates the switch 51, which in turn discharges capacitor C1 through transistor Q1 in order to cause laser module 6 to illuminate for a predetermined period of time. In this embodiment, the circuitry 100 in FIG. 9 is implemented using a printed circuit board having the trace diagrams illustrated in FIGS. 10 and 11. Alternate embodiments of the invention may utilize any other suitable circuit to cause the laser module 6 to illuminate.

The circuitry 100 may be configured to cause the laser module 6 to illuminate for any desired length of time. In one embodiment, the laser is illuminated for between about 7.5 milliseconds (ms) to about 12.5 ms per shot, i.e., each time the firing pin contacts the backer 4 of cartridge 10.

A plurality of different cartridges sized to fit different-sized gun bores may be sold as a kit. Alternatively, a kit may include one or more cartridges of the same or different sizes along with different-sized O-rings. Each different sized O-ring(s) can be placed on a cartridge in order to configure it to fit a particular caliber of gun, and O-ring(s) can be removed and replaced with other O-rings in order to change the size of the gun bore into which the cartridge fits.

In one embodiment of the present invention, a laser trainer cartridge of the present invention may be configured to fit into an adapter sheath (or "sheath") 200. Among other things, the sheath 200 acts as an adapter to allow a laser trainer cartridge 10 to operate in a firearm having a different caliber than the laser trainer cartridge 10 itself is designed to operate. For example, a laser trainer cartridge 10 configured to fit in a .32 caliber firearm may be sold as a kit with a plurality of adapter sheaths 200 that allow the cartridge to be used with larger-caliber firearms (e.g., .38 caliber, .40 caliber, .44 caliber, etc.).

Figure 12:
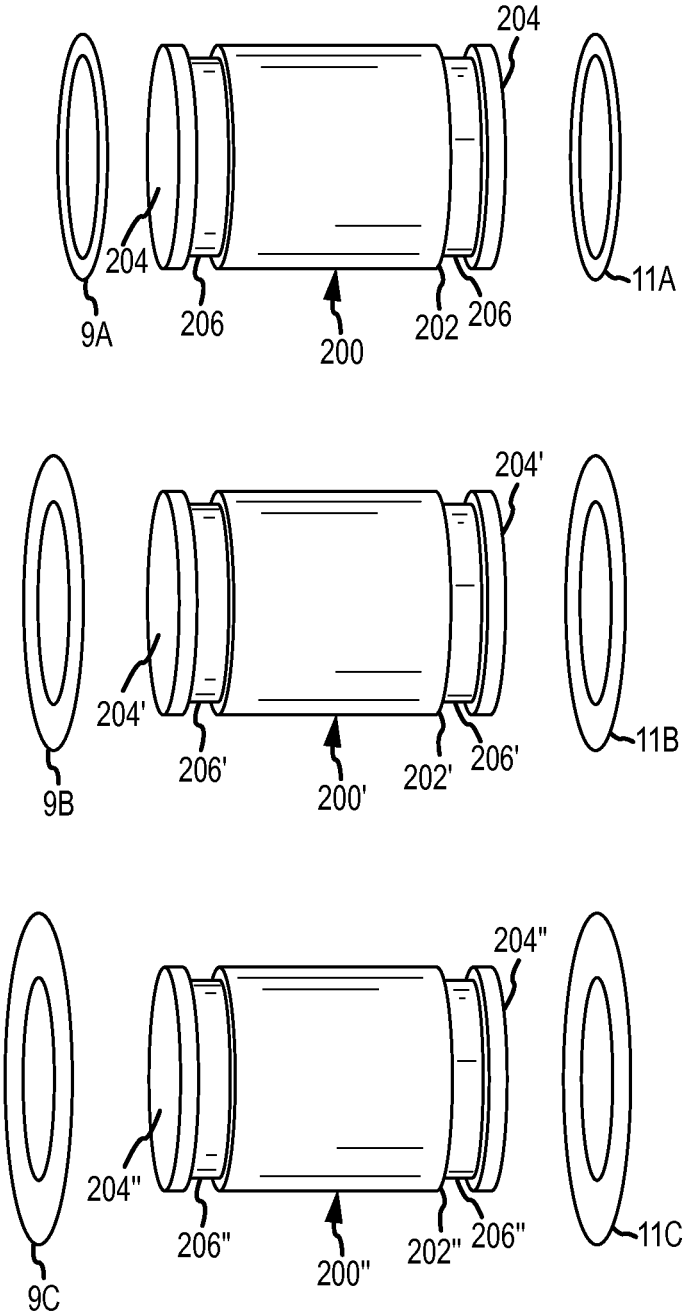
FIG. 12 depicts a sheath according to an aspect of the invention.

As shown in FIG. 12, in one embodiment, an adapter sheath 200 has a generally cylindrical body configured to fit into a particular sized firearm. The sheath 200 is preferably at least partially open at both ends to allow the cartridge 10 to be inserted into and retained in the sheath cavity 204, and to allow light from laser module 6 to be emitted, and the firing pin to strike the backing 4 of the cartridge 10.

Adapter sheath 200 preferably includes at least one O-ring on its exterior surface 202 that has a diameter equal to, or greater than, the diameter of the gun bore into which the sheath 200 is configured to fit. The O-ring for the sheath can be any type of structure as the O-rings previously described for cartridge 10.

In one embodiment, a sheath 200 of the present invention includes two O-rings 9A, 11A; one positioned at either end of sheath 200 in grooves 206, and each O-ring 9A, 11A has a diameter equal to, or up to 0.030" greater than, the diameter of the gun bore. As with the O-rings of the cartridge described previously, these O-rings form a snug fit with the gun bore to help prevent the sheath/cartridge combination from falling out of the firearm, as well as to reduce vibration from the firing pin hitting the back of the cartridge 10 and to retain the sheath/cartridge combination in place during use.

The cartridge 10 can be retained inside the sheath 200 in any suitable manner. In one embodiment, the O-rings 9 and 11 of cartridge 10 are sized to interface with the interior surface of the sheath 200 to help retain cartridge 10 within cavity 204 of sheath 200. In another embodiment, the front portion of the sheath includes a lip or narrowed portion that prevents the cartridge 10 from passing through the front of the sheath, yet does not occlude or interfere with the light emitted from the laser module 6. Any other structure(s) may be used in conjunction with the present invention to retain the laser trainer cartridge 10 within the sheath 200.

Each of the sheaths of FIG. 12 has an outer surface, one or more (and as shown, two) O-rings on the outer surface, an interior cavity with an inner diameter wherein the inner diameter for each of the plurality of sheaths is the same. The one or more O-rings on each respective sheath have a different outer diameter than the outer diameter of the one or more O-rings on each other sheath. In this manner, a single cartridge laser trainer with a single outer diameter, which is defined by one or more O-rings on the cartridge laser trainer can be positioned in the interior cavity of each sheath so a single cartridge laser trainer can be used for guns with different bore sizes. For example, sheath 200' is in all respects the same as sheath 200 except that O-rings 9B and 11B have a larger outer diameter than O-rings 9A and 11A so that sheath 200' fits into a larger gun bore than sheath 200. Sheath 200" is in all respects the same as sheath 200 and 200' except that O-rings 9C and 11C have a larger outer diameter than O-rings 9A and 11A or O-rings 9B and 11B so that sheath 200" fits into a larger gun bore that either sheath 200 or sheath 200'.

In some embodiments, the cartridge 10 may be configured to produce a sound (e.g., a gunshot sound) when the firing pin strikes the backer. The cartridge may include a speaker or any other suitable device to produce a sound, and may produce any desired sound.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A kit comprising;

(a) a cartridge laser trainer comprising an outer casing and one or more O-rings positioned on the outer casing, the cartridge laser trainer configured to fit snugly within a sheath having a particular inside diameter, and further comprising a backer that is positioned so as to be struck by a firing pin of a gun when the gun is fired, a circuit and a laser, wherein the backer has a first position wherein it does not contact the circuit and a second position wherein it contacts the circuit, the backer moving from its first position to its second position when it is struck by the firing pin, and the circuit causing the laser to illuminate when it is contacted by the backer, wherein the cartridge laser trainer includes (a) a front portion and a front O-ring positioned on the front portion, the front O-ring having an outer diameter equal to or greater than an interior diameter of a sheath into which the cartridge laser trainer fits, and (b) a back portion and a rear O-ring positioned on the back portion, the rear O-ring having an outer diameter equal to or greater than the inner sheath diameter of the sheath; and (b) a plurality of sheaths, wherein each of the plurality of sheaths has an outer surface, and one or more O-rings on the outer surface, an interior cavity with the inner diameter, wherein the inner diameter for each of the plurality of sheaths is the same, the one or more O-rings on each of the plurality of sheaths defining an outer diameter different than the outer diameter defined by the one or more O-rings of at least one other of the plurality of sheaths, and each of the plurality of sheaths being configured to fit into a gun barrel of a particular diameter, wherein the one or more O-rings of each of the plurality of sheaths has a diameter equal to or greater than the diameter of the gun barrel into which the sheath is configured to fit.

2. The kit of claim 1 wherein each of the plurality of sheaths is configured to fit into a different sized gun barrel.

3. The kit of claim 1 wherein each of the plurality of sheaths has a first end and a second end, the first end being open and the second end being open.

4. The kit of claim 1 wherein the one or more O-rings on each of the plurality of sheaths has a diameter equal to, or up to 0.030" greater than, the diameter of the gun barrel into which the sheath is configured to fit.

5. The kit of claim 1 wherein each of the plurality of sheaths has a first portion having a first O-ring and a second portion having a second O-ring, the first O-ring having a diameter equal to or greater than the diameter of the gun barrel into which the sheath is configured to fit, and the second O-ring having a diameter equal to or greater than the diameter of the gun barrel into which the sheath is configured to fit.

6. The kit of claim 5 wherein the first O-ring has a diameter of equal to, or up to 0.030" greater than, the gun barrel into which the sheath is configured to fit, and the second O-ring has a diameter of equal to, or up to 0.030" greater than the gun barrel into which the sheath is configured to fit.

7. The kit of claim 1 wherein the backer is comprised of urethane.

8. The kit of claim 1 wherein the backer has a durometer of between 75 to 95 Shore A.

9. The kit of claim 1 wherein each sheath has (a) a front portion with an O-ring on the front portion, and (b) a back portion with an O-ring on the back portion.

* * * * *